United States Patent [19]

Thut

[11] Patent Number: 4,786,230

[45] Date of Patent: Nov. 22, 1988

[54] DUAL VOLUTE MOLTEN METAL PUMP AND SELECTIVE OUTLET DISCRIMINATING MEANS

[76] Inventor: Bruno H. Thut, 9580 Stafford Rd., Chagrin Falls, Ohio 44022

[21] Appl. No.: 800,791

[22] Filed: Nov. 22, 1985

Related U.S. Application Data

[63] Continuation of Ser. No. 594,241, Mar. 28, 1984, abandoned.

[51] Int. Cl.[4] ..... F04D 1/12

[52] U.S. Cl. ..... 415/88; 415/182; 137/825; 137/832

[58] Field of Search ..... 415/116, 117, 88, 98, 415/102, 103, 209, 182; 137/825, 832, 834

[56] References Cited

U.S. PATENT DOCUMENTS 3,291,473 12/1966 Sweeney et al. ..... 415/88

*Primary Examiner*—Robert E. Garrett
*Assistant Examiner*—John T. Kwon
*Attorney, Agent, or Firm*—Fay, Sharpe, Beall, Fagan, Minnich & McKee

[57] ABSTRACT

This invention relates to improvements in molten metal pumps for the transfer of principally molten aluminum and zinc from specialized molten and holding furnaces through fluidics control means downstream of the pump to control the direction of flow of molten metals at 1200°-1600° temperatures. The molten metal pump is characterized by both upper and lower dual volute pumps driven by the same shaft, each having separated intake filtering adjacent the top and bottom of the pump unit. Separated and extended molten metal intake permit molten metal flow from a submerged environment through restricted peripheral ingress slots both about the top and bottom and into both top and bottom independent voluted pump impellers. The invention permits direct use of the novel pump with aluminum metal, whose oxide impurities settle and/or zinc metal whose oxide particles float, in the molten state without pump modification. Separate dual peripheral filter ingress zones lead into separated dual volute pumps removing hard particulates suspended in the melt, illustratively; spalled fire brick refractory chunks, scraps of unmelted metal and other foreign inclusions from causing excessive wear and tear or total destruction of the interior volutes and their related impellers of the pumps.

The combination of the so-improved pump in cooperation with the divergent stream transition control provides an improved portable of selectivity of one egress out of two diverging exit channels through molten metal flow control remote from the melt.

6 Claims, 4 Drawing Sheets

DUAL VOLUTE MOLTEN METAL PUMP AND SELECTIVE OUTLET DISCRIMINATING MEANS

This application is a continuation of U.S. Ser. No. 594,241, filed Mar. 28, 1984 now abandoned.

BACKGROUND OF THE INVENTION

This invention provides over-all means for circulation of molten metals under a substantially constant head of pressure and flow rate in a substantially laminar flow downstream of the egress of the pump which is adapted for use submerged in a melting/holding furnace.

It further provides a control means for direction of a selected one of two downstream egress channels with molten metal by means of combination of the molten metal pump in downstream co-operation with a downstream flow selector means for said selection of any one of the said two channel means, said flow selector means preferably integral with the single output orifice of the molten metal pump.

The selector means may also be operated independently physically as a separated unit downstream of a prior art pump or a gravity fed source of molten metal characterized by having a constant pressure head and flow rate as might originate from molten flow into a tundish placed in a holding furnace on an upper foundry floor, without integral connection with a pump, the latter operations are not often feasible and limit foundry flexibility in moving molten metal from one furnace to another, or from one furnace to two or more separated downstream operations.

By means of the preferred combination, one may feed a single metal flow sequentially to one of two or more operations. Metal may be sequentially cast, for example, from a molten supply into various downstream operations producing solid metal, forms such as ingots, sheets, foils, tubes or rods, etc., by use of one unit fluidic control or a plurality of said unit controls in series, if desired.

Both soluble and insoluble gross solids including fluxes, slag, unmelted metals including iron, silicon, etc., firebrick refractory fragments, aluminum oxide occlusions, etc., which can damage the downstream volute pumps accumulate upon normal handling of molten metal in refractory furnaces and tend to collect upon and after formation in melting and holding furnaces. As the foregoing particulate impurities native to handling molten zinc are inherently lighter and tend to float, they tend to be drawn into top fed impeller pumps. Hence, for handling molten zinc bottom fed pumps are normally selected. On the other hand, with molten aluminum and its alloys, occluded impurities are most often heavier than the melt and tend to agglomerate and settle. Liquid aluminum metal fed into bottom-fed volute-impeller pumps have been generally avoided.

The prior art has suggested multiple specialized molten metal pump assemblies by use of alternative pump elements, including drive shafts, pump impellers as illustrative. Shorter drive shafts have been used where top feed of molten aluminum metal to a top fed impeller pump is desired. If metallic zinc was to be handled, a longer drive pump shaft and co-related inverted cup impeller fed from a bottom ingress pump was assembled. Pump assemblies have been so designed as to provide bottom fed molten metal pumps. See Sweeney et al., U.S. Pat. No. 3,048,384.

One prior art solution has proposed a system of rotary baffles, referred to as "deflector disks", driven on the same vertical drive main pump shaft provided controlled circumferential clearance of molten metal from the melting furnace by adjustment of the disk clearance on the common drive shaft both above and below annular top and bottom fed single pump ingress means. See Sweeney et al., U.S. Pat. No. 3,291,473.

Here, a volute pump has been described to be useful to pump molten metal inwardly through a single pump ingress means fed from the top. However, a single pump impeller devoid of volute means is employed.

It should also be noted that in the top and bottom entry modifications, patentee does not use a volute pump and the utility does not permit the higher temperatures essential in handling molten metals and is intended for generally lower temperature melting point chemicals. In either case, entry is through and past rotary, driven, deflector disks slightly upstream of the metal flow entry into the pump.

It is well known, however, that similar rotary power driven disks spinning within an enclosed clearance provide high shear dispersive forces. The high shear rate produced effects unwanted dispersion of foreign matter as referred to above which contaminates the melt stream. Rotary dispersion action of the described classifiers tends to defeat the filtration intended and to break up and disperse insoluble solid matter.

Here, dual volute pumps operating from a single shaft separately receive influx of molten metal which first is filtered of all suspended solids in the melt by an upper and lower restricted ingress zone completely about the periphery of the submersible pump which insures that the pump clearances are not unduly worn or damaged by entry of any one of the foregoing unmelted accumulated particulates.

One principal advance over the prior art herein disclosed is embodied in the moving parts free, selective fluidics flow control means, particularly when operated in conjunction with the dual ingress dual volute pump, both of which are more fully described herein.

The liquid metal flow upon egress from the pump and entering the downstream transition control means is controllably diverted into a selected one of two divergent controlled downstream conduits or channels without interference with over-all through-put flow rate.

Commonly the principal control of molten metal flow egressing the pump has been solely through control of the pump operation. The limitation has been primarily an on-off; flow or no-flow; operation where the driving motor means control of resultant metal flow through the pump is not instantly responsive to the "on-off" signals.

When an "on-off" flow control is employed in a moving stream of metal, particularly, a "water hammer" develops which is detrimental to the pump function and may cause breakage of the graphite parts required in the pump manufacture.

This invention makes possible downstream selection of alternative melting and holding furnaces and re-circulation within and between such furnaces and alternative delivery of a single stream of molten metal to one of two pre-selected downstream operations.

The fluidics devices of this invention can be used in tandem in plural number, if desired, making continuous operation from a single melting furnace, or a plurality of melting or holding furnaces feeding a series of varying downstream operations electively and sequentially.

SUMMARY OF THE INVENTION

The invention as herein disclosed provides a fluidics operated molten metal flow control device operable downstream of a melting and/or holding furnace under a relatively constant ingress head and laminar flow rate. Under the foregoing conditions, a fluidics controlled transition zone controls flow of a single upstream entering volume of liquid molten metal into one of two downstream alternative bifurcated egress channels. The dual channels outwardly diverge from one another at an acute angle forming interiorly thereof the basic position of solid conjoined triangular splitter element to be affixed thereon.

The acute angle of the splitter element extends upstream and originates the demarcation point of internal stream flow division. The division apex line defines the origin of the outwardly diverging channels downstream of the splitter and physically extends operably upstream into said transition zone volume.

Upon passage of a single molten metal stream into the upper ingress or opening into said transition zone, the single stream is diverged into a selected one of the two divergent downstream outlet channels but directed in a single stream through a common and expanded volume sometimes referred to herein as the transition zone and one side of the splitter in a pre-selected downstream channel.

The fluidics control zone transition piece integrally joins the single upstream entry channel through a transition zone of expanding volume, split by the leading acute angle edge of a splitter element partially intruding upstream into the aforesaid transition zone but downstream to establish the inner walls of the two diverging bifurcated channels. The downstream outwardly bifurcating single channels of the transition zone are herein referred to for convenience as conduits or channels A and B. Corresponding streams flowing through said channels are correspondingly referred to as stream A and stream B.

Only one selected stream (A or B) flows through a corresponding downstream channel (A or B) under a given flow control at any one time.

The specific design of the fluidics control transition zone and its co-operative elements can be specifically modified to meet required ends for specific operations and demand conditions.

One modification of the transition control zone permits a fail safe operation so that flow of stream B through conduit or leg B, for example, establishes that stream B will dominate (unless manually over-ridden).

To operate thereafter through conduit A, the remote control device must be set or fixed in operating position to re-establish and maintain an elected flow pattern through non-dominant leg A. Stream operation through conduit B will be resumed automatically upon release of the control otherwise directing the molten stream through channel A. (See FIG. 7.)

In another, possibly preferred, metastable mode of operation the transition zone is as shown in FIG. 6. Here, both conduit A and stream A, or conduit B and stream B only require appropriate injection of a puff of compressed gas from the remote control to effect input of a controlled jet of control stream gas into the appropriate control orifice and into and upstream of the transition zone to impinge upon the power stream to convert the stream flow from channel A to channel B, or vice versa.

Initial design of the fluidics controlled transition zone may restrict the cross-sectional area of one selected channel or leg A or B.

While it is possible to devise the cross-sectional patterns of the channels immediately upstream of, within, and downstream of the transition control including the single immediate ingress as may be illustrated elsewhere, it is preferred in the best mode of practice known, that the cross-section be of generally elliptical form wherein the major axis is vertical, as is illustrated in FIG. 8. Such sectional control assists in maintaining laminar flow and optimum practical use of the "Coanda" or "wall effect". Other modifications are within the knowledge of the fluidics art. Other possible control modifications are not precluded, however.

In the preferred form of the invention the molten metal pump is constructed upstream and integrally a part of the downstream ingress control channel and metal stream into the single entry passageway of the downstream fluidics control transition zone.

While the pressure head and flow control conditions essential to functional operations of a fluidics control and transition zone means may be established in theory and principle by gravity flow from an elevated source of supply of the required molten metal, such means are not amenable to varied plant conditions and operations. Operations are then limited to singular and unique positions and locations within specialized building structures. Further, in gravity operation special efforts may be necessary to assure the fluidics control unit be supplied with auxiliary heat to prevent (or to re-melt) metal freeze-ups when the gravity unit is forced to be shut down unexpectedly.

While a compressed gas useful in operating the transition control zone is usually an inert gas, illustratively nitrogen, in some instances minor percentages of usefully reactive gases, illustratively chlorine and/or argon, etc., may be blended into the control gas stream as an aid in maintaining purity of the molten metal.

Impact of the pressurized control gas stream interiorly of the transition zone below the initial ingress point and upstream of the splitter initiates turbulence and development of a gas bubble. The development of a "separation bubble" initiates the essential destruction of the existing "Coanda" or "wall effect" and momentary stream flow instability within the transition zone. However, as the destabilized stream flows close to the alternate and diverging wall, the "wall effect" brings the molten metal stream into the alternative and diverging bifurcated downstream leg. This completes a directional flow change over and into the selected, alternate, downstream channel or leg as defined by the splitter apex permanently located in the enlarged volume further downstream and interior of the expanding transition piece volume.

The dynamic energy content inherent in the molten metal power stream coursing downstream from the pump (or head) is the principal source of energy in the fluidic dynamics of the fluidics flow directional control unit described herein.

A secondary compressed gas control stream originating at the remote control point provides the ancillary energy source essential to effect growth of the separation bubble and destroy the pre-established wall effect. The compressed gas power stream is sometimes referred to as the secondary control gas stream.

So far as is presently known, movement and transfer of molten metals and control of flow has been principally useful in increasing and sustaining production of castings, sheet, foil, etc., by especially designed molten metal pumps principally constructed of a refractory non-metal, most often graphite, to withstand the elevated temperatures, erosion and corrosion due to moving contact with molten metal at temperatures illustratively from about 1200° to 1600° F. at a choice of several downstream plant operations.

Only two pumping conditions were previously controlled. The power source, compressed air or a long shaft directly driven electrical motor, could be "off" or "on". Molten metal flow either "stopped" or being actively pumped from within the melting furnace downstream thereof.

Molten pump failures presently most often occur during start-up or shut-down due to sudden flow rate changes. Hammer effects when a pump is turned "off" develop severe strains in the pump and wear through reduced clearances within the pump is accelerated. With the present combination of pump and remote control means associated, and preferably integral therewith, pump shut-off to control flow is no longer mandatory.

Use of optional forced melt circulation within the melting/holding furnace, now made practicable, has several advantages. The time necessary to prepare a melt may be shortened. Development of metal oxides and other impurities within the melt has less time to be produced due to increased melting rate with forced circulation of the melt over the solid surfaces. Melting of solid metal scrap is possible at higher furnace turnover rate if the shear rate of movement of the liquid phase over the solid scrap surfaces during melting periods is enhanced.

However, known materials and means useful to change direction of flow which changes shear rates as the molten metal powerstream is either throttled down, as in stopping, or increases in shear, if starting up. This action occurs in prior art valves depending upon moving parts to throttle a moving stream, as illustrative.

Known valves are not adaptable to the control of high temperature molten metal streams, permitting as illustrative, an alternative pumping circulation phase within the melting furnace and a second egress phase where the prepared molten metal is delivered to a point of use apart from the melting furnace.

As indicated above, molten metal-air (oxygen) contact must be avoided wherever possible because of the high oxidation reaction rate (of aluminum and oxygen) and consequent loss of useful metal due to the rapid formation of insoluble contaminating heavy aluminum oxide particles, as is well understood.

This invention provides a novel means of control of the flow of molten metal through selected and alternative channels or conduit means without corrosion or wear upon the surface of moving control valves designed to change rates of flow and thereby undergo wear. Change in flow directions into one of two elected flow paths as is accomplished herein without materially interrupting the normal flow rate of the principal or "power" molten metal stream has not been heretofore known.

In the utilization of the fluidics controlled transition control means of this invention the requirements of standardized pressure, flow rate and the laminar flow character of the stream are important to the dependable operation of the device.

In use, the pump assembly as herein described is submerged in molten metal. Molten metal enters the upwardly extending central cup of the top volute pump by passage through an extended controlled molten metal clearance zone or volume which provides effective filter means. The extended filter zone is created by means of an extended special ingress volume defined by the dual top horizontal spaced apart plates of the pump assembly through which top liquid entry occurs and a like bottom ingress zone created by spacer feet between the interior flat bottom of the furnace and the bottom horizontal plate of the submerged pump base. Note that both the entire periphery of the pump, both top and bottom, define a filtration zone ingress means inherent when the pump is in use. These clearance entry slots or filtration elements assure absence of insoluble accretions in the incoming melt.

Further, as the volume of ingress liquid entering the pump originates over both top and bottom of the pump periphery, thus the developed shearing stress is insufficient to disintegrate occluded insoluble "tramp" materials commonly contaminating a molten metal during melting, holding and transfer. Chunks of refractory brick, undissolved silicon metal, occluded insoluble metal oxides, etc., cause at best excessive wear, and more often abrupt breakage of pump parts which are at close tolerances.

Carry through of insoluble metal oxide accretions is not only objectionable in processing molten metal, but insoluble metallic impurities in the melt, if not removed downstream, are a cause for rejection of completely formed metal parts and useful products derived therefrom.

The disclosure herein comprises two closely related inventive entities most often in advantageous functional combination, but each of which can be operated separately, but always advantageously arranged in series comprising the improved molten metal pump and the correlative downstream control means.

The principal novel entity in the combination comprises a molten metal fluid flow directive control device dependent for its operation upon a reliable source of molten metal flow. Relatively constant flow rate, constant pressure head and freedom from occluded insoluble particulates and essentially laminar flow are derivatives essential and dependent upon a quality molten metal pump upstream of the said control.

The flow control device of this inventive combination is characterized by a single fluid ingress channel, dually divergent bifurcated egress channels downstream and intermediately of said single ingress and the bifurcated egress channels a fluidics controlled transition zone, a stream directing exit orifice terminating said single ingress means downstream of said egress and entering said transition zone, oppositely disposed inwardly directed pressurized gas control ports adapted to control differential gas pressures interiorly of said egress zone at said exit orifice, said transition zone expanding in volume downstream to accommodate a single enlarged entry zone into said dual bifurcated downstream egress channels which channels separate and diverge at an acute angle, interiorly thereof is set a conjoined solid triangular splitter element the apex of which extends upstream into the downstream terminus of said expanded transition zone volume; said diagonally opposed gas pressure control ports upstream in the transition provide control from a remote point of origin of said essential pressure controlling gas ports.

The pump source specifically referred to above of a molten metal flow having relatively constant laminar flow rate, pressure head and freedom from "tramp" particulate solids is preferably operated in integral combination with the foregoing fluidics molten metal flow control device. These separately and dual functions, but preferably physically unitary elements, comprise in combination a unitary molten metal pump with selective directional output control means downstream thereof. The combination assembly provides interrelating and inter-related improvement in the handling of refractory molten metal by functional immersion in melting/holding furnaces.

DETAILED DESCRIPTION OF THE PREFERRED EMBODIMENT

Figures 1, 2:
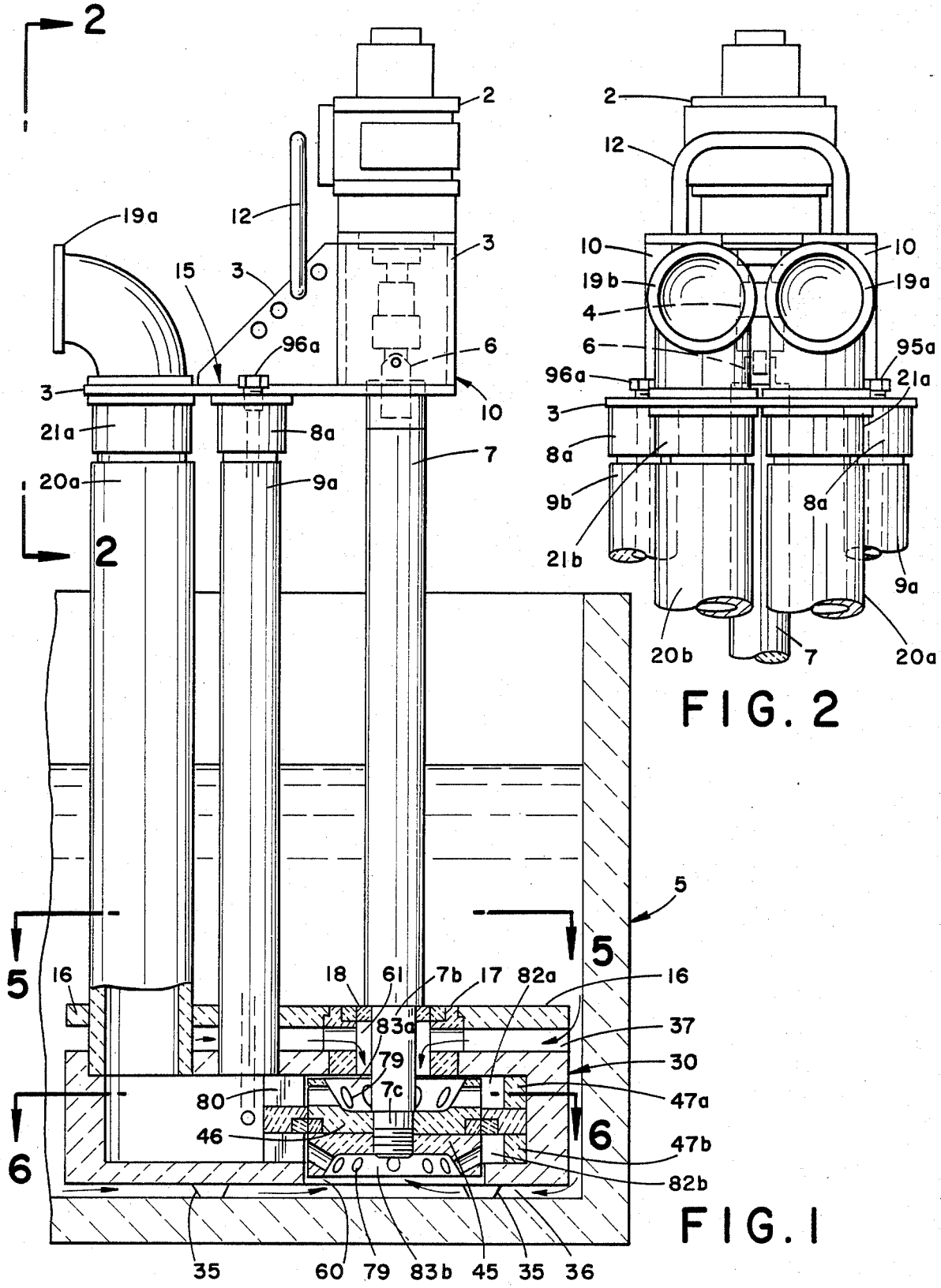
FIG. 1 is an elevation partially in section noted with parts broken away of a molten metal pump in operative association with a molten metal bath or melting furnace.
FIG. 2 is a partial sectional view along the line 2—2 of FIG. 1.
Figure 3:
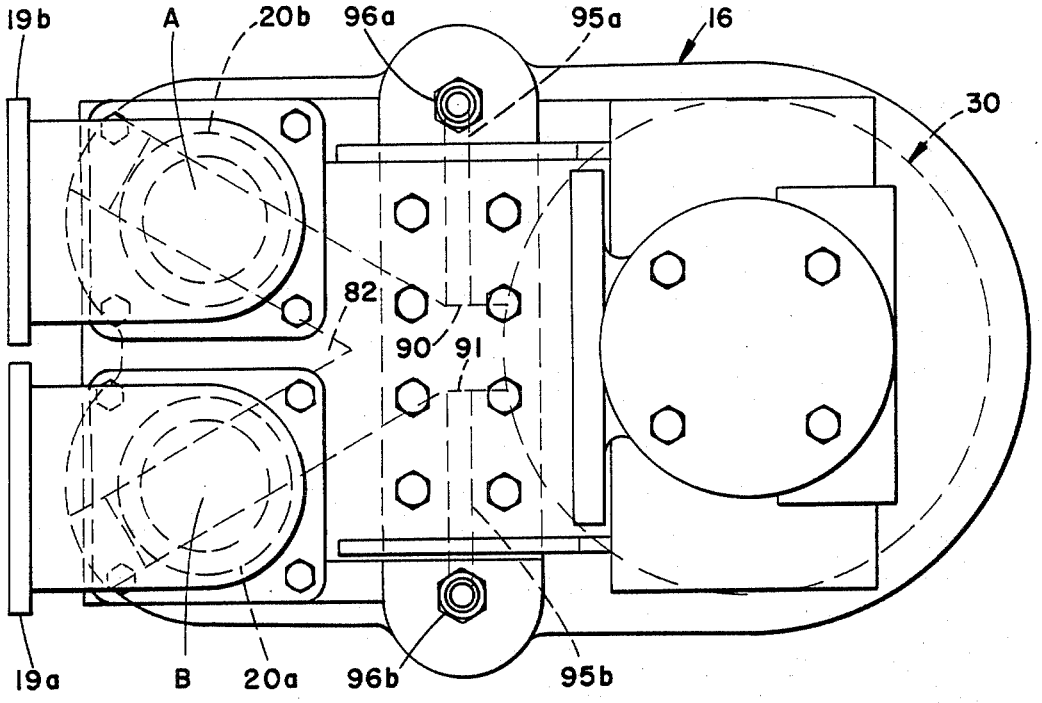
FIG. 3 ia a top view of the unit pump assembly indicating co-relation of the pump assembly with a preferred a selective fluidics control zone.
Figure 4:
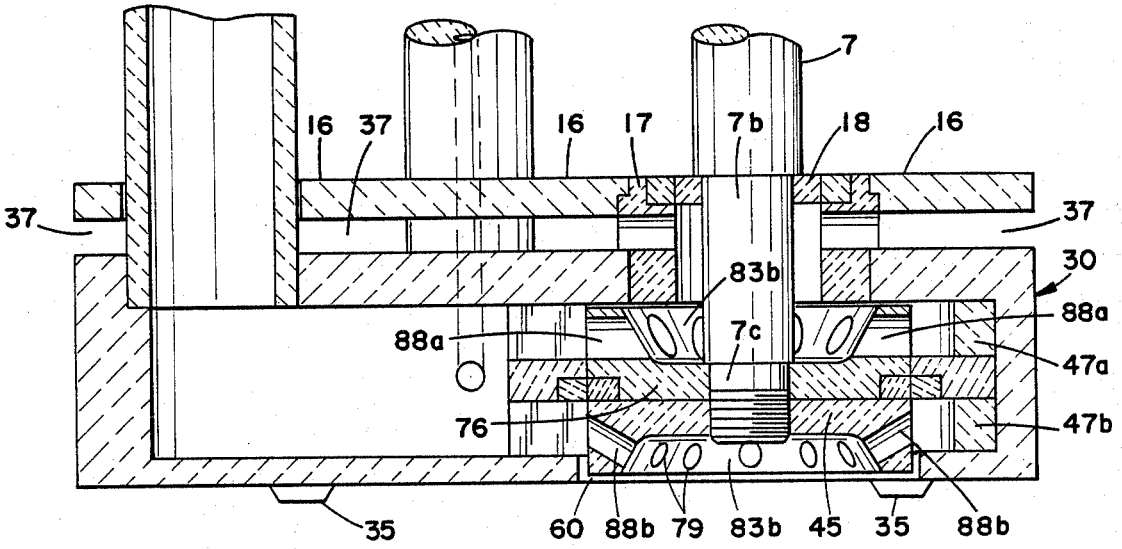
FIG. 4 is an enlarged partial elevation in section detailing essentials of the molten metal pump and a fluidics control zone.
Figure 5:
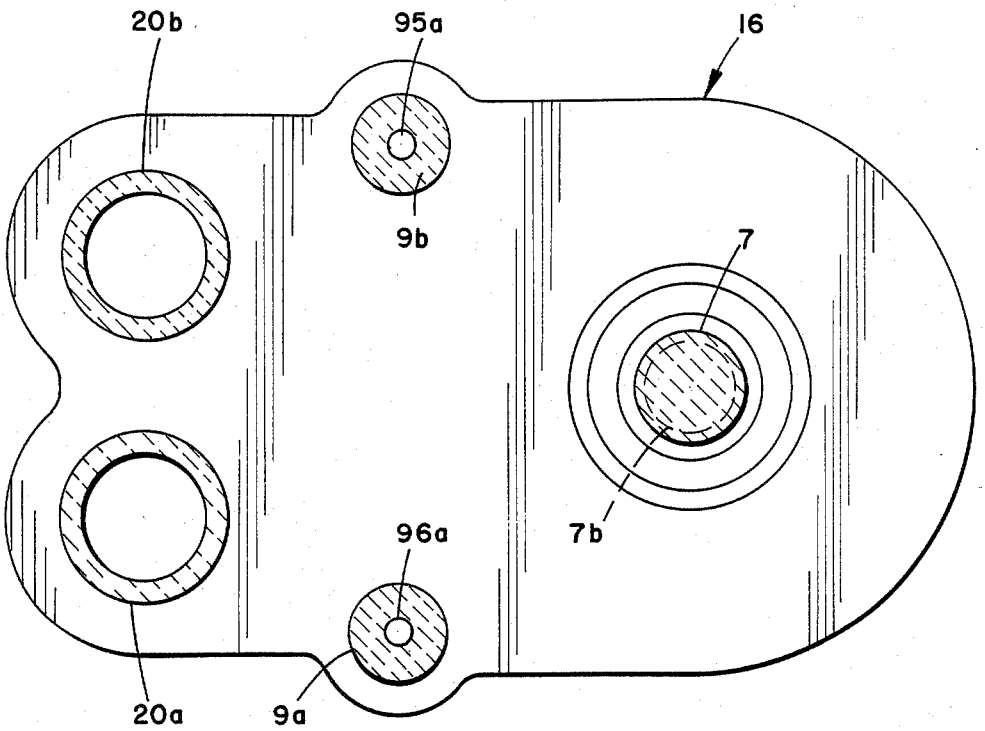
FIG. 5 is a top sectional view along the line 5—5 of FIG. 1.

This invention is directed to a fluidics flow control device to make possible division of a single molten metal egress stream into a pre-selected one of two possible egress conduits. In the broadest aspect, the flow control device can be detachably affixed downstream of a relatively constant source of molten metal flow having the required pressure head and flow rate to provide reliable operation through a downstream fluidics operated directional control means providing for selectional direction of the metal stream through one of two available channels.

A plurality of the fluidics control devices may also be set up in series or in a continuous downstream sequence to provide a plurality of controllably directed metal streams from but one original single molten metal stream.

A controlled source of molten metal having requisite pressure head and controlled flow rate is preferably obtained from use of a molten metal pump submersed in a molten metal melting and/or holding furnace. It is also conceived of originating in select foundries where the melting/holding furnaces are a floor or more above the casting or metal forming operations. This means, depending upon gravity flow, may supplant the otherwise essential liquid metal pump. A gravity system will permit operation of the fluidics control device of this invention when the output rate is held relatively constant. Gravity attachment is not often adaptable to general plant operation as a separate flow control unit. The use of a good quality prior art molten metal pump is also potentially useful in sequential combination of one, or a plurality of more than one fluidics flow control devices as herein disclosed.

The preferred embodiment of the fluidics control zone of this invention is integrally a part of and supported within a molten metal pump assembly. The combination becomes a unitary piece of processing equipment. In use, it is functionally submerged in a molten melting/holding furnace. The unitary assemblies herein are portably movable upon demand from one metal/-holding furnace by means of power lifting units. Advantageous plant operation flexibility is thereby allowed.

The preferred embodiment of the fluidics control unit of this invention is shown and described as a unitary part of an inventive metal pump, also described here, particularly accommodated to the transfer of both molten aluminum and molten zinc.

Heretofore, because of the essential inherent differences in physical and chemical behavior of these metals in molten state, either two separately designed pumps, or one pump having elective parts, assembled for the specific elected metal has been disclosed in the prior art.

This writing discloses a pump integrally assembled to operate in conjunction with a fluidics control device. The herein disclosed improved metal pump can be used without modification and provides molten metal flow characteristics particularly desirable in direct downstream operation of the said fluidics control unit first above introduced.

Referring more particularly to the drawings:

A metal melting/holding furnace 5 in FIG. 1 holds portable molten metal pump assembly 10 partially immersed into and elevated into position by power lift means through hanger 12 of mounting assembly plate 3 of top motor mounting assembly 15. Air driven motor 2 supported by a top motor mounting assembly plate 15 drives pump 30 through power shaft 7 and through universal joint 6 and bayonet coupling 4. A pair of centrally drilled vertical posts **9*a* and 9*b*, and a pair of centrally drilled hollow risers 20*a* and 20*b* pass through horizontal support plate 3 terminating in elbows 19*a* and 20*a* above the support and riser sockets 21*a* and 21*b*, supportably connect below and adhesively set within submerged rectilinear pump base 30. Posts 9*a* and 9*b*, centrally drilled risers 20*a* and 20*b* and all other parts below the post and riser sockets subjected to be submersed into molten metal furnace box 5** are fabricated of refractory substances, graphite being generally used. Silicon carbide is often used where wear is greatest. All parts are machined to close tolerances; and assembly, where not otherwise shown, is obtained through use of high temperature adhesives.

Figure 6:
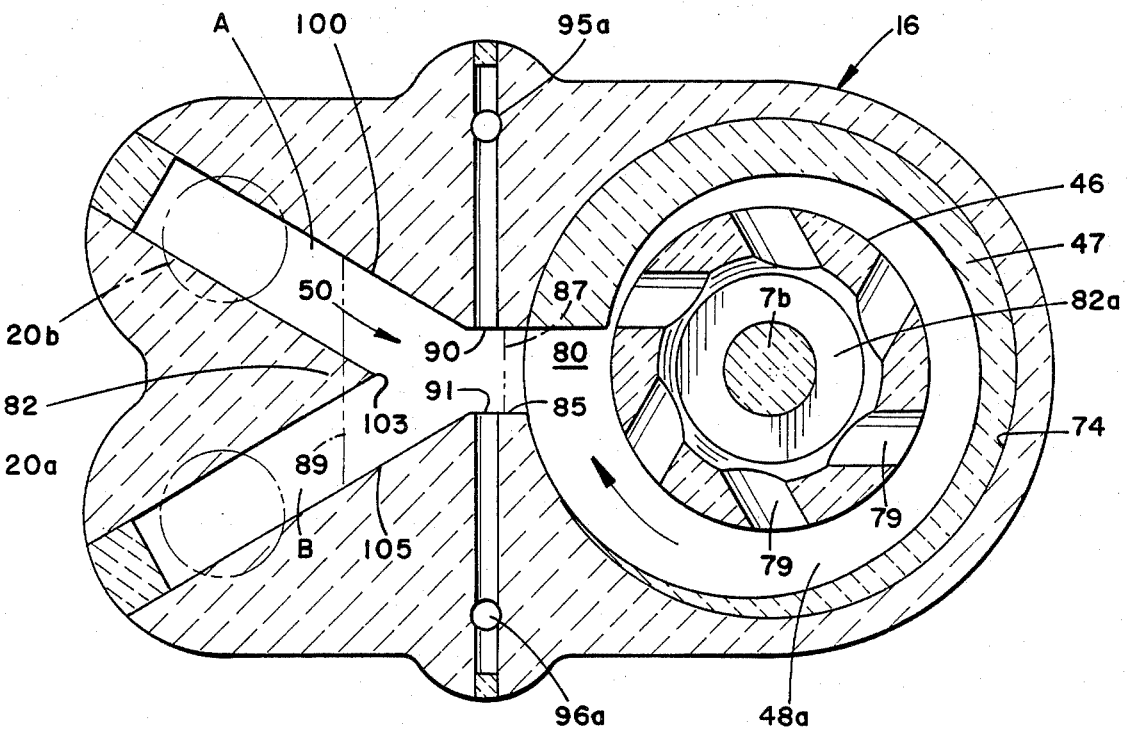
FIG. 6 is a sectional view along the line 6—6 of FIG. 1 detailing operational elements of the fluidics control device and volute pump.

Driven shaft 7 is rotatably supported in top plate 16 of box 30 and extends centrally downward through bore 60 to a threaded shaft of bottom end **7*c*. Bearing mount 17 and mounting ring 18 are fitted in a top vertical bore through plate 16 and support shaft 7*b* rotatably within said assembly. Lower shaft end 7*c* threadably engages both upper volute impeller 46 and lower volute impeller 45 of dual volute pumps mounted back to back. Both 45 and 46 impellers are simultaneously driven in a clockwise direction (as indicated in FIG. 6). Axially centered disk-like impeller elements 83*a* of impeller 46 extends upwardly and outwardly and 83*b* extends outwardly and downwardly from impeller 45 within bore 60. Each of these disk-like impeller elements 83 create an axial upper and lower entry volume 82*a* and 82*b***

(FIG. 6–FIG. 7) accommodated to receive molten metal from interior of furnace 5 through separate entry means as follows:

Upon clockwise rotation of shaft 7 through activation of motor 2 volute impellers 45 and 46 are rotated within their respective stationary volutes 47*a* and 47*b*. Molten metal flows from the submerged molten metal environment of furnace 5 through restricted top entry volume 37 created between top plate 16 and top plate of box 30 extending completely about the pump base periphery and into the interior of the axial volume of element 83*a* of top volute impeller 46. Separately, molten metal flows downardly about the exterior periphery of box 30 through restricted passageway 36 into bottom bore 60.

Spacer studs or legs 35 mounted on the planar bottom of box 30 define a separate and restricted entry passageway interiorly of disk-like axial volume 83*b* of lower volute 45. Each of the above restricted and separated entry passageways 36 and 37 act to filter out suspended solids which may be unmelted chunks of metal scrap, silicon metal incorporated as an alloying element in the melt which will ultimately dissolve, contaminants which include insoluble foreign material including refractory brick spalled from furnace walls, chunks of cement, insoluble metal oxide accretions, etc., much of the above, particularly insoluble "tramp" occulsions when present contribute to excessive wear and tear and often breakage of pump elements including volutes and impellers.

With driven shaft 7 actively driven through motor 2, centrifugal forces acting upon each of the molten metal streams from the furnace interiors flowing interiorly into the axial cavities 83*a* and 83*b* force the molten metal therein outwardly and rearwardly (to the direction of rotation) through plural impeller passageways 79 under the so increased centrifugal pressures developed. Dual fluid molten metal streams are expelled from their respective volute pumps in the volumes between the stationary volute pieces 47*a* and 47*b* and volute impellers 45 and 46 into a single efflux stream downstream of the pump through molten metal pump exit orifice 80.

In the preferred form of the invention as here more specifically of concern, the single exit stream of molten metal from the exit orifice 80 is pumped through common exit channel 85 (FIGS. 6 and 7) which is also the common ingress point of the molten metal stream into the upstream end of fluidics controlled transition zone 50 at 87.

At this point the molten metal enters the transition zone under substantially a constant pressure and flow rate of the liquified metal.

If one elects, the fluidics operated transition control means 50 can be totally replaced with an uninterrupted conduit section (not shown) from the upstream entry at 87 therein through a single downstream channel (functioning as a chosen one of two bifurcated downstream legs or channels A or B).

The foregoing change eliminates the added utility and adaptability of the fluidics control zone 50 and the choice of distribution of any one of two downstream liquid molten metal outputs at a given time without fully utilizing the inherent improvements previously disclosed in exposition of the improved molten metal pump assembly.

However, the preferred form of the invention embraces both the advances in versatility and capacities of the metal flow as are inherent in the above described molten metal pump unit having as integrally a part thereof the fluidics capacity to effect a change in direction of the pump outlet stream without movable mechanical parts.

Figure 7:
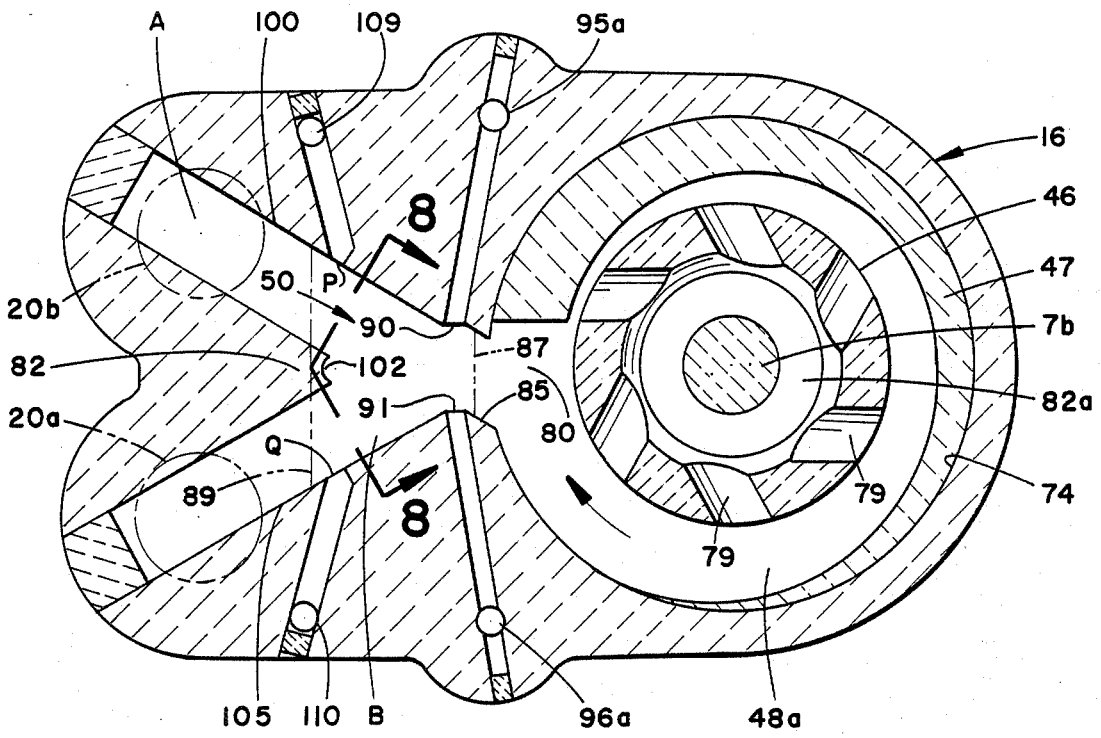
FIG. 7 is detailed development of an alternative arrangement of another specific modification of the fluidics zone.

Returning to the drawings, FIG. 6 and FIG. 7 pick up the downstream flow of molten metal as it egresses under required flow conditions from the upstream pump and egresses downstream therefrom into the fluidics control transition zone 50 of the downstream flow direction fluidics selector device.

The fluidics control zone for referral is sometimes herein referred to and descriptively identified as a control zone transition piece 50 although the entire control unit is preferably integral with the improved pump.

Satisfactory operation of the fluidics control zone as a unit embraces not only the immediate transition zone 50 but also generally including the flow control zone set out by dotted lines 87 and 89, and further includes consideration of the immediate ingress zone 85 and the two legs A and B of the alternative flow streams A and B downstream.

In the preferred form of the invention, the cross section of the connecting conduit between the liquid metal leaving the pump at 80, the cross sectional pattern through any section of the expanding volume transition zone 85 and the two legs A and B are of importance to obtain the optimum influence of fluidics forces. The "Coanda" or "wall effect" depends upon relative constancy of pressure head, pressure upon the molten stream flowing within the enclosed walls and a substantially lamellar or axial flow of the metal through the control unit except under activation of a flow change direction by impingement on and into the downstream power stream of molten metal by means of a controlled pressurized gas stream.

Figure 8:
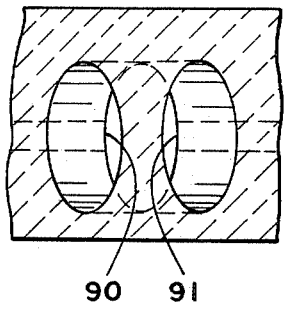
FIG. 8 is a sectional view as seen upstream of the broken line 89 of FIGS. 6 and 7.

It is preferable in the construction of the fluidics control for the purposes herein that the immediate pump egress 85, the control zone 50 and the two bifurcated downstream legs be constructed from graphite tubes having an elliptical section wherein the major axis thereof is vertical. Eddy currents within this critical zone are not encouraged, maximum side "wall effect" is obtained over the largest mass of flowing metal with minimum wall area reactive response at the top and bottom of the aforesaid passageways. Due regard for the ratio of the major axis to the minor axis of the elliptical section will take into consideration the molten metal pump output rate which is to pass through the fluidics zone 50 per unit of time. FIG. 8 illustrates a general elliptical section as preferred in the above critical flow control zone construction.

It is within this zone that certain fluidic principles are made effective from a remote control point (not shown). The remote control point houses and includes means of controlling and establishing a variety of gas pressures which may be above atmospheric, at atmospheric, or merely vented to normal atmospheric pressures, or combinations of both by gas passageways such as are illustrated in FIGS. 6 and 7 entering into the transition zone at 95 and 96 and specifically as vents under inert gas pressures both above and at atmospheric pressure and generally designed to vent to the atmosphere when present as shown at 109 and 110 in FIG. 7.

Available at the remote control point leading to transition zone 50 are individual gas lines connecting with interiors of the transition zone at the indicated predetermined locations in gas ingress and egress orifices. The upstream pair of orifices entering the control zone 50 at 90 and 91 originating through inert gas lines 95*a* and 96*a* are used in alternating function. If gas pressure above atmospheric is applied to one orifice 90 from its remote control source, the other orifice 91 generally is held at or near standard atmospheric pressures.

However, in FIG. 7 gas lines 109 and 110 are normally merely vents through gas control pipelines from control zone 50 exhausting at atmospheric pressures, but controlling pressures at the observed gas ingress positions P and Q downstream of the transition zone.

Referring to FIG. 6, a point of beginning presumes the fluidics conditions in the generally expanding volume downstream in transition zone 50 are such that the molten metal power stream flows into the zone at 87, past control ports 90 and 91, and is held by the "Coanda wall effect" in contact with wall 100 of channel or leg A of the bifurcated egress zone terminating transition zone 50 at 89. Here the molten stream passes leading edge 103 (or 102) of the solid splitter 82 and continues downstream through channel A to be discharged through riser 20*b* to a predetermined forming operation, a secondary holding furnace, or perhaps to be re-circulated within the melting furnace 5.

When required for use in a second set of downstream production requirements or holding conditions, the operator can re-direct the molten metal stream entering the transition zone at 87 to the alternate leg or channel B by directing, from the remote control location, that a puff of substantially inert gas under pressure be discharged through gas line 95*a* and orifice 90 into control zone 50. Orifice 90 is positioned slightly downstream of line 87 in wall 100. As the pressurized gas stream puff impacts the downstream metal power stream at orifice 90, a turbulent condition results in the power stream and a separation bubble develops. The developed turbulence creates an instability in the power liquid metal stream along the wall 100 causing it to veer towards channel or leg B. As the power stream contacts wall 105 of leg B, the "Coanda or wall effect" takes over, the power stream becomes re-attached to wall 105.

The power metal stream continues to flow in channel B completely changed in course from channel A as it flows past divisional apex 103 of the splitter 82. The now re-directed flow of the molten metal continues to flow downstream in and through channel B and out riser 20*a* to a second, and alternative pre-determined mode of functional use of the diverted molten metal power stream.

As illustrated in FIG. 6, a bi-stable fluidics system is designed into the transition zone 50. To return the downstream metal flow to channel A and riser 20*b*, a counter puff of compressed gas directed through upper support plate 3 (FIG. 1), vertical drilled post 9*a* and gas line fitting 95*a* from the remote control position and a compressed gas supply source into disruptive contact with the power stream through orifice 91 to again reverse and re-establish the original flow through channel A. The control puff of gas enters into a separation bubble existant and adjacent the established power metal downstream leg or channel (here B) to effect the elected power stream flow directional change.

As the combination of pump and downstream control means operate with molten metals, a fail safe device may be desireable and used to advantage in specific applications. FIG. 7 illustrates a modification of FIG. 6 wherein a more complex modification of the transition zone 50 is shown. A mono stable flow path dominates and prevails should there be a failure in the inert gas control supply essential to the domination of a given leg, stream or channel A or B.

Referring to FIG. 7, it will be noted that inlet power gas control ports 95*a* and 96*a* have been displaced upstream towards the dual volute pump assembly. The effect is to alter slightly the angle of attack of control ports 90 and 91. Note also exit orifice 85 enters transition zone 50 at 87 at an offset angle more favorable to ingress of the power molten metal stream flow from the pump at pump volute egress 80 into the transition control zone 50 at 87.

An arcuate cusp 102 has been cut into and removing the former sharp leading edge 103 of splitter 82 entering the transition zone 50. Cusp 102 extends upstream into transition zone 50 to cause an increase in internal pressure on the high pressure side of molten metal power stream as it flows through expanding volume transition zone 50. Increased internal pressure increases the stability of the liquid metal flow direction under possible minor flow variation in its rate and/or pressure, for example.

Vents 109 and 110 which have been added downstream in the transition zone (near the zone exit line at 89) lead through associated gas conduit means interiorly of control zone 50 and provide means to control gas pressures as required at points of entry P and Q into downstream legs A and B. within downstream limits of transition zone 50 at 89.

Note that liquid metal power ingress into transition zone 50 at 87 is slightly asymmetrical or at a slightly offset angle. The resultant fluidic forces favor fluid flow through channel B, which forces will dominate and maintain the control unless a pneumatic gas control signal through control port 91 is constantly maintained.

Thus, the basic monostable flow pattern of the power stream can be employed should one elect to process a molten metal stream through channel B for principal end uses where no molten metal overflow problems from the egress of riser 20*b* occur. For example, flow from riser 20*b* may normally recirculate liquid metal back through the melting or holding furnace 5 to increase the melting rate of scrap metal solids being remelted. For a specific term, however, the pneumatic gas control port 91 could be activated for other specific operations while being carefully observed. Should the operator's attention be diverted, the shift back would automatically return the hot metal stream to channel B.

Having thus described the invention, it is now claimed:

1. A submersible molten metal pump continuously operable at temperatures in excess of 750° C. comprising a supporting planar base and top, a top horizontal plate substantially separately supported above, spaced apart from but parallel with planar base top; said space defining a separated upper level filter means; a corresponding planar plate bottom of said supporting base having a plurality of downwardly depending volume restricting spacer legs integral therewith, said spacer legs upon submersion of said pump interiorly of a melting/holding furnace thereby creating a separated lower liquid metal filter ingress means through said intake volume means; interiorly of said supporting base a vertically separated pair of back-to-back volute impeller pumps operably and centrally affixed to a common vertical driven air-cooled shaft extending upwardly of and supported from within the interior of said base to a rigidly mounted air exposed shaft driving means, both of said upper and lower filter ingress intake volumes terminating in oppositely disposed, axially centered cup-like impeller receptacles integral with their respective volute impellers and rotatably interior of upper and lower fixed volute members creating thereby a common molten egress port downstream of said volute pumps discharging into a fluidics diverter valve integral and downstream of said dual volute pumps.

2. An ordered unitary non-metallic functionally cooperative assembly of a filter, pump and remotely controlled fluidics diverter valve operable when submersed in molten aluminum and/or zinc metals at temperatures in excess of 750° C. which comprises a rectilinear box-like base housing unit, the base plate and two top plate elements being planar and parallel to one another; said base supported on the flat floor of a melting furnace by a plurality of downwardly depending spacer button legs, which upon submersion in functional position and use establish a molten metal lower level ingress interiorly of said box housing and pump; said dual planar to elements being likewise similarly spaced apart to severally function to filter both said lower level and said upper level ingress of molten metal interiorly of said pump housing; said housing interiorly adapted to support a power drive upwardly extending elongated air-cooled vertical pump driven shaft centrally positioned above and within the pump section of said housing, said driven shaft within said housing driving a pair of back-to-back vertically adjacent volute impeller pumps operating in fixed and separate volute chambers within said housing: filtered molten-metal ingress means through said two top elements comprising a multi-plate filter to remove particulates less dense than said melt and similar lower level ingress through the said restricted planar floor filter zone to remove particulates of greater density than said melt; said diametrically opposed volute pumps driven by said common vertical shaft discharging continuous filtered and controlled molten metal streams into and through the common ingress port of a fluidics diverter valve provided with a selective downstream fluid control means comprising compressed gas ingress ports adapted to selectively impinge substantially inert gas under pressure directly upon said molten metal diverter valve power stream to redirect through fluidics principles molten metal stream flow downstream thereof through a predetermined one of said available channels of said fluidics diverter valve to a preselected downstream station, said gas ingress control means operable from a control point remote from said assembly.

3. A molten metal submersible fluidics operated dual directional non-metallic fluidics diverter valve and alternative flow direction remote control device operable at temperatures in excess of 750° C. by which an upstream first entry conduit carrying a pre-filtered liquid molten metal downstream under a pre-established constant head and filtered flow rate originating from an integral upstream molten metal pump and co-submersible and integral therewith interiorly of a metal melting furnace exiting into said entry conduit as a particulate-free power stream is divergible into a preselected one of two alternate bifurcating downstream conduits by means of a transition piece of expanding internal volume thereby creating a fluidics control zone, said control zone transition piece bifurcated interiorly, downstream and centrally by fixed placement therein of a triangular shaped splitter element the apex of said triangle directed upstream determining a point of origin of a fluidics controlled diversion of direction of the original liquified metal power stream into a selected one of two bifurcated downstream conduits; a pair of diametrically aligned, oppositely disposed compressed, essentially inert, gas inlet orifices within a zone of influence of the said pre-filtered first powered stream and conduit, adapted to provide controlled alternative inert gas flow under pressured ingress to within and egress from selected single ones of said orifices upon demand and pair of external gas conduits remotely operatively associated with a common source of said compressed inert gas providing a source injection of said gas through a preselected one of said inlet orifices to impact internally said molten metal power stream upstream of said transition piece effecting thereby a fluidics directional control upon said power stream as it passes into and through said fluidics diverter control device.

4. The non-metallic fluidics operated diverter valve and flow control apparatus assembly of claim 3, wherein the interior cross-section of all molten metal conduits downstream of the power entry conduit into said transition zone are ellipses whose major axes are substantially vertical to the horizonal plane of the base of said control assembly.

5. A molten metal submersible fluid flow control device functionally operable at temperatures in excess of 750° C. upon a particulate-free source of molten metal; said source further characterized by a relatively constant pressure head, flow rate and temperature comprising a single stream of fluidized metal entry through an ingress channel and dually divergent bifurcated egress channels spaced downstream thereof; and intermediate said single controlled fluid metal stream ingress channel and egress channels, a fluidics controlled transition zone; said fluidics controlled transition zone comprising oppositely disposed and inwardly directed dual inert gas control ports at and about said fluid entry ingress channel controlling transverse entry of compressed inert gas impingement on and from a selected port from a remote control point upon demand, said transition zone expanded in volume downstream of said ports to accommodate non-turbulent molten metal liquid entry and passage through the downstream end of said transition zone which comprises dual, bifurcated egress channels which channels initially diverge and separate at an acute angle forming thereby and interiorly thereof a divergent triangular splitter element the apex of which extends upstream into the said downstream expanded transition zone.

6. A remote controlled directionally selective non-metallic fluid flow control unit adapted to be submersed in molten metal liquid metal held within a melting furnace at temperatures at temperatures in excess of 750° C., which comprises in ordered sequence: a molten metal pump having an upper and lower melt ingress means, a lower pump intake adapted to remove suspended particulates more dense than said melt and an upper pump intake adapted to remove suspended particulates of less density than said melt; a single vertical driven shaft driving a pair of oppositely disposed volute impeller pumps horizontally about, said shaft downstream of said dual filters but discharging the filtered melt therefrom downstream in a single coherent stream under relatively constant head and flow rate into the single melt ingress port of a fluidics diverter valve control means; said fluidics control valve having oppositely disposed substantially inert gas injection control ports having egress into a directional transition control entry zone of increasing downstream volume characteristic of a fluidics diverter valve, said ports oppositely disposed about the single melt ingress port and immediately downstream of the melt entry into said valve; said dual and oppositely disposed gas injection ports oriented to direct, from a remote control station, an impinging flow of pressurized gas through one preselected control port to activate said melt stream to flow into and through a preselected one of the two bifunctional diverting downstream channels characteristic of said fluidics diverter valve.

* * * * *

UNITED STATES PATENT AND TRADEMARK OFFICE

CERTIFICATE OF CORRECTION

PATENT NO. : 4,786,230

DATED : November 22, 1988

INVENTOR(S) : Bruno H. Thut

It is certified that error appears in the above—identified patent and that said Letters Patent is hereby corrected as shown below:

At column 13, line 19, "to" should be --top--

Signed and Sealed this

Sixteenth Day of May, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,786,230

DATED : November 22, 1988

INVENTOR(S) : Bruno H. Thut

It is certified that error appears in the above—identified patent and that said Letters Patent is hereby corrected as shown below:

At column 14, line 52, the second occurrence of "at temperatures" should be deleted.

Signed and Sealed this

Twelfth Day of September, 1989

*Attest:*

DONALD J. QUIGG

*Attesting Officer*

*Commissioner of Patents and Trademarks*